United States Patent [19]

Reed

[11] 4,170,166

[45] Oct. 9, 1979

[54] AIR MOTOR WITH EXPANSIBLE CHAMBER

[76] Inventor: John H, Reed, P.O. Box 321, Kermit, Tex. 79745

[21] Appl. No.: 802,174

[22] Filed: May 31, 1977

[51] Int. Cl.[2] ..... F01B 1/06

[52] U.S. Cl. ..... 91/481; 91/491; 92/38; 92/44; 92/165

[58] Field of Search ..... 417/273, 473, 412; 92/37, 39, 64, 44, 165, 38; 91/481, 492, 491

[56] References Cited

U.S. PATENT DOCUMENTS

| | | | |
|---|---|---|---|
| 1,546,706 | 7/1925 | Bezzenberger | 92/44 |
| 2,326,464 | 8/1943 | Jones | 91/481 |
| 2,328,439 | 8/1943 | Esnault-Pelterie | 417/271 X |
| 2,373,526 | 4/1945 | Zellos | 417/412 |
| 2,627,750 | 2/1953 | Titus | 92/38 X |
| 2,735,369 | 2/1956 | Turvey | 92/38 X |
| 3,396,633 | 8/1968 | Ryzner | 91/481 X |
| 3,558,242 | 1/1971 | Jenkyn-Thomas | 417/374 |

FOREIGN PATENT DOCUMENTS

| | | | |
|---|---|---|---|
| 796683 | 4/1936 | France | 417/273 |
| 1093995 | 5/1955 | France | 417/412 |
| 535977 | 4/1941 | United Kingdom | 417/473 |

*Primary Examiner*—Carlton R. Croyle
*Assistant Examiner*—Edward Look
*Attorney, Agent, or Firm*—Marcus L. Bates

[57] ABSTRACT

Air motor having a crankcase about which a plurality of expansible chambers are arranged so that a crankshaft journaled within the crankcase can be connected to a bellows of the expansible chamber by a rod assembly. The crankshaft moves a cam means which in turn moves a valve assembly for controlling flow of compressed air into and out of the expansible chambers. Each expansible chamber is formed by a bellows concentrically aligned and placed within a cylinder to form an annular chamber therebetween. The rod assembly is received through a guide and seal means which maintains the rod axially aligned with respect to the expansible chamber, and seals the interior of the crankcase from the expansible chamber assembly. An intermediate chamber is formed between the crankcase and expansible chamber which greatly increases the efficiency of the motor.

8 Claims, 14 Drawing Figures

AIR MOTOR WITH EXPANSIBLE CHAMBER

BACKGROUND OF THE INVENTION

Leas U.S. Pat. Nos. 157,406 discloses a pump having a bellows type expansible chamber with the chambers being positioned radially about a central shaft member C. Mealey 1,109,349; Logan 2,146,123; and Kimsey 3,036,557 teach motors and pumps having radially disposed expansible chambers arranged about a common crankshaft so that a source of pressure fluid can be utilized to rotatably drive the main shaft. Miller 2,918,018 discloses a rotary pump having a shaft connected to one end of a plurality of bellows with the other end of the bellows being connected to a common support member such that the bellows are radially spaced about the shaft.

Other examples of known prior art: Cooper U.S. Pat. Nos. 184,461; Hibbard U.S. Pat. Nos. 938,146; Hyman U.S. Pat. Nos. 2,052,472; Rummel U.S. Pat. Nos. 2,122,352; Logan U.S. Pat. Nos. 2,146,123; Payne U.S. Pat. Nos. 2,830,544; Pigeroulet U.S. Pat. Nos. 3,267,861; Dikerson U.S. Pat. Nos. 3,730,054.

The employment of a bellows positioned within a cylinder and arranged to drive a crankshaft has heretofore been envisioned by others; however, there are many technical problems which have prevented the before mentioned motors from receiving proper acceptance in the market place. Primarily, the bellows are subjected to lateral movement along with reciprocatory movement and accordingly the uneven bending of one sidewall of the bellows respective to the other results in a short life thereof. Failure of the prior art bellows establishes communication between the expansible chamber and the crankcase thereby subjecting the crankcase to contamination of the power fluid.

In order to overcome this undesirable design feature various complicated mechanisms have been incorporated in an attempt to maintain the axial centerline of the bellows aligned with the axial centerline of the cylinder as evidenced by Kimsey U.S. Pat. Nos. 3,036,557 and Griswold 2,945,451; however, these complicated expedients are difficult to maintain and expensive to manufacture.

Accordingly, it would be desirable to provide an air motor having an expansible chamber formed between the bellows and a cylinder, with guide means being provided by which a connecting rod between the bellows and the crankshaft is maintained in exact axial alignment respective to the bellows and cylinders, and further that the guide means have associated therewith a seal means by which fluid contained within the crankcase is maintained properly separated from the power fluid which reciprocatingly drives the rod.

SUMMARY OF THE INVENTION

This invention is related to air motors having a plurality of expansion chambers which are formed between an expansible bellows and a cylinder.

In its broadest form, the motor includes a crankshaft rotatably supported within a crankcase and having a rod assembly journaled to the crankshaft and connected to the bellows so that movement of the bellows imparts reciprocatory motion into the rod which in turn imparts rotatable motion into the crankshaft.

The bellows is maintained in exact axial alignment with respect to the cylinders by the provision of a special rod guide means interposed between the bellows and the crankcase. The guide means further includes a seal means which sealingly engages a marginal reciprocating length of the rod assembly.

The guide and seal are supported from a housing. The housing and seal cooperate with the bellows and engine case to form an isolated chamber within which oil is contained. The isolated chambers communicate with one another and augment the movement of the radially spaced bellows.

In another more specific form of the invention, guide means are circumferentially spaced about the interior of the bellows to enhance the concentric relationship between the bellows and the cylinder.

A dual valve means controls the symmetrical flow of power fluid into and out of the expansion chamber and is actuated by a cam means. The cam means is actuated by rotational motion of the crankshaft.

Accordingly, a primary object of this invention is the provision of improvements in air motors and more specifically in the provision of a bellows arrangement which eliminates the necessity for a piston reciprocatingly received within a cylinder.

A further object of this invention is the provision of a guide means by which a bellows and a cylinder of an expansible chamber are maintained in axial alignment with one another.

Still another object of this invention is the provision of an improved rod assembly by which a crankshaft is connected to a bellows of an expansible chamber, wherein the expansible chamber is formed between an enclosure and the bellows.

A still further object of this invention is the provision of a combination guide and seal means housed within an air motor which has an expansible chamber therein, wherein the expansible chamber is formed between a bellows and a cylinder, and wherein the seal is housed to form an isolated chamber which augments the power of the motor.

A further object of this invention is the provision of an air motor having an expansible chamber formed between a bellows and a cylinder, which includes a combination guide and seal means arranged to form another chamber which is isolated from the crankcase of the motor, and at the same time a special rod assembly is connected between the bellows and the rotating crankshaft of the motor.

The above objects are attained in accordance with the present invention by the provision of a two part rod assembly and a guide and seal means by which the rod is sealingly and reciprocatingly maintained in proper aligned relationship respective to the bellows while at the same time the bellows is maintained concentrically aligned respective to the cylinder as it is expanded and contracted in response to flow of fluid pressure thereinto.

The above objects are attained in accordance with the present invention by the provision of a combination of elements which are fabricated in a manner substantially as described in the above abstract and summary.

These and various other objects and advantages of the invention will become readily apparent to those skilled in the art upon reading the following detailed description and claims and by referring to the accompanying drawings.

DETAILED DESCRIPTION OF THE PREFERRED EMBODIMENT

Figure 1:
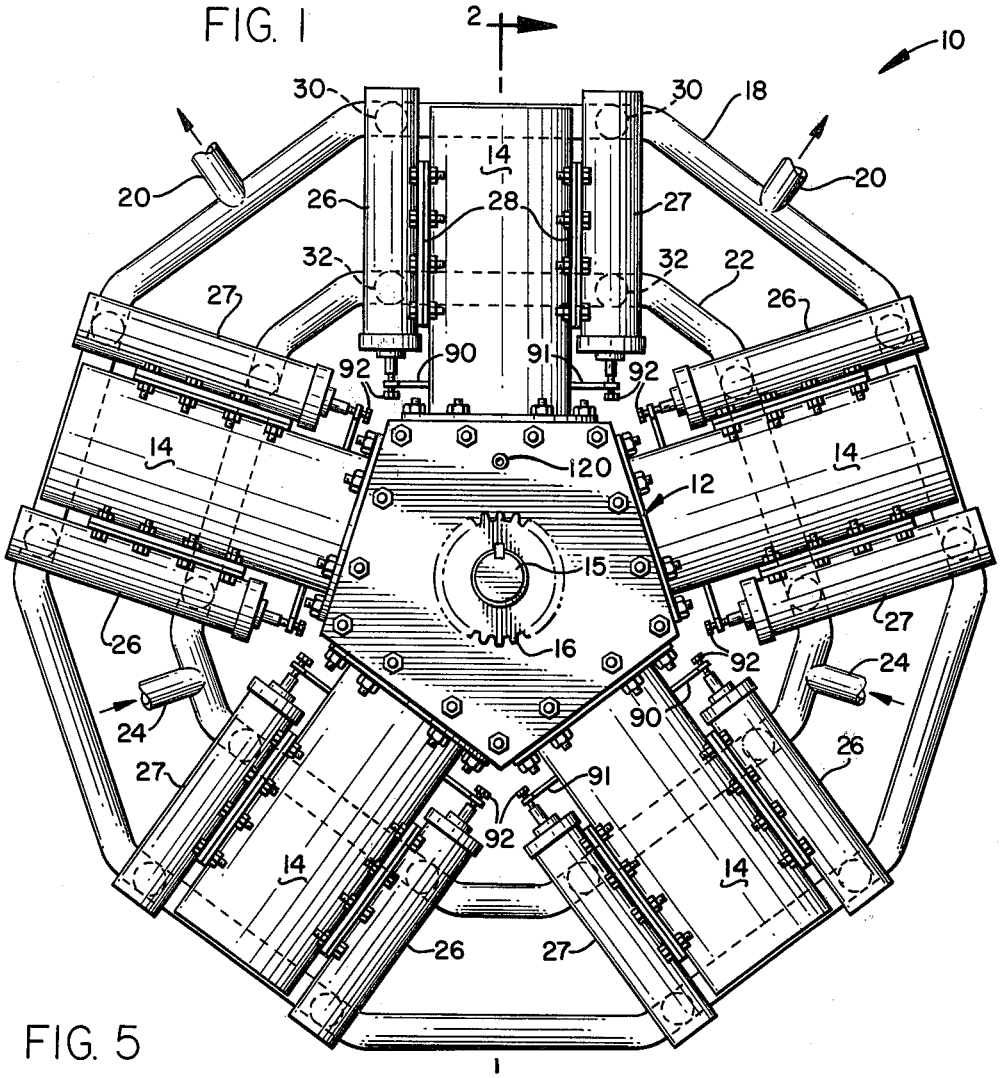
FIG. 1 is a front elevational view of an air motor made in accordance with the present invention.
Figure 5:
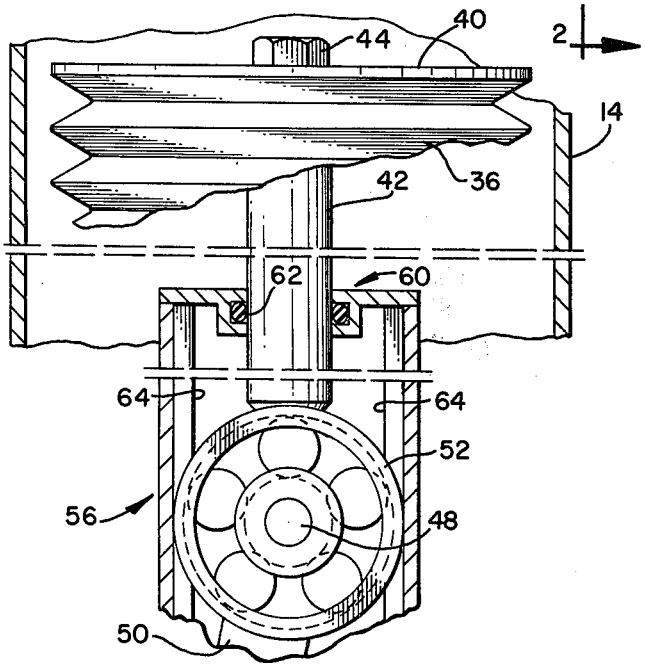
FIG. 5 is an enlarged, detailed view of part of the apparatus disclosed in FIG. 2, with some parts being removed therefrom and some of the remaining parts being shown in cross-section.
Figure 6:
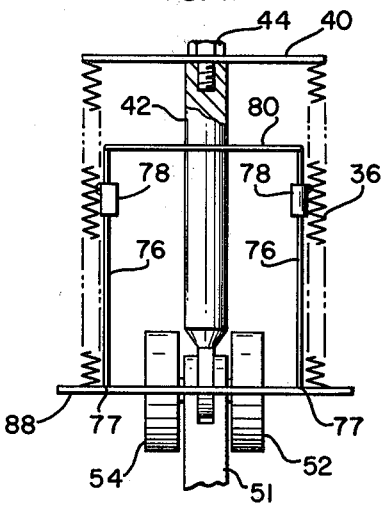
FIG. 6 is a detailed view of part of the apparatus disclosed in the foregoing figures.

The various different figures of the drawings disclose an air motor 10 made in accordance with the present invention. The air motor includes a crankcase 12 having a plurality of cylinders 14 radially disposed about a common crankshaft 15. Opposed ends of the crankshaft are journaled in sealed relationship to the crankcase by using the prior art expedients known to those skilled in the art. The power output end of the shaft is provided with a gear 16.

As seen illustrated in FIG. 1, an intake manifold 22 is supplied with power fluid, in the form of compressed air, by means of inlet conduits 24. Each of the cylinders is also connected to an exhaust manifold 18 through which spent power fluid is exhausted at outlet 20.

Valve assemblies 26 and 27 are identical in construction and located in opposition to one another. The valve assemblies are connected to cylinder 14 in the indicated manner seen at 28 so that power fluid can flow into each valve assembly at 32 while spent power fluid is exhausted into the exhaust manifold at 30.

Figure 2:
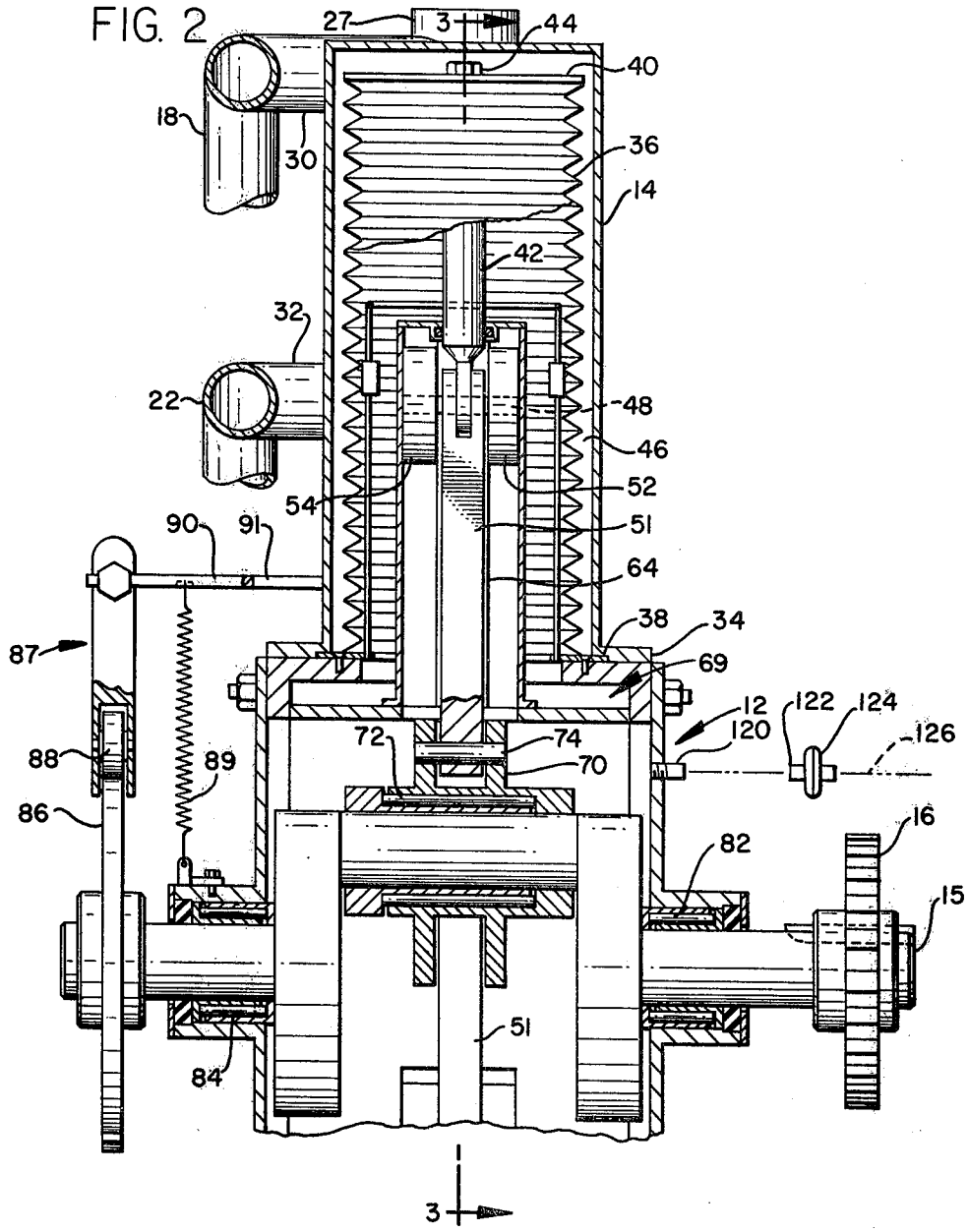
FIG. 2 is an enlarged, detailed, fragmented, part cross-sectional view taken along line 2—2 of FIG. 1.
Figure 9:
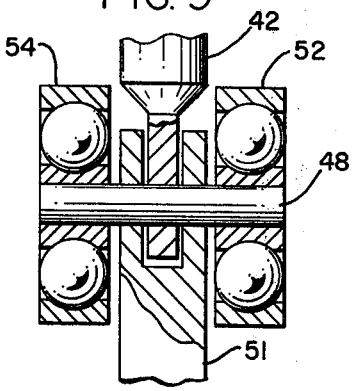
FIG. 9 is a fragmented, enlarged, cross-sectional view of part of the apparatus disclosed in FIG. 2.
Figure 10:
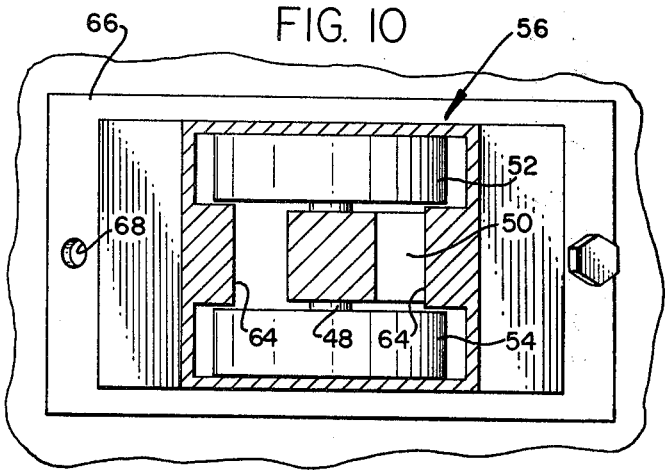
FIG. 10 is a cross-sectional view taken along line 10—10 of FIG. 3.

As best seen illustrated in FIG. 2, each of the cylinders are bolted to the crankcase by a flange 34. A bellows 36 has a lower end thereof which terminates in a flange 38. The flange is captured within the illustrated circumferentially extending groove formed within the cylinder flange, and in underlying relationship respective to the lower end of the cylinder. The upper terminal end 40 of the bellows is provided with the illustrated plate-like closure member to which the free end of a bellows rod 42 is attached. Fastener means 44 rigidly affixes the terminal end of the bellows rod to the before mentioned plate-like closure member. Hence, the cooperative action between the concentrically arranged bellows and cylinder wall provides an annulus 46 therebetween. Opposed sides of the annulus are connected to the before-mentioned valve assembly as will be better understood later on in this disclosure.

A seen in FIGS. 2, 5, 9 and 10, link pin 48 journals the adjacent ends of bellows rod 42 and link rod 50 or 51 to one another in order to provide a rod assembly comprised of a reciprocating bellows rod 42 and an oscillating link rod 51. The link rod has a marginal end received within the crank case. Followers 52 and 54, in the form of roller bearings, are attached to the link pin 48 and form part of a guide means 56. The guide means of the present invention includes a housing in the form of the illustrated outwardly extending hollow member which diverges at 58 in a downward direction into attachment to the crankcase. The outermost end 60 of the housing terminates in a seal 62 which sealingly engages a marginal medial length of the reciprocating bellows rod therewithin, thereby isolating the interior of the crankcase from the bellows mechanism and from isolated chamber 69. Guide rails 64 are mounted within the housing and positioned to slidably capture the follower, or roller bearings, therebetween to maintain the bellows rod in axial alignment respective to the bellows and to the cylinder. The lower end 66 of the housing terminates in a flange. Apertures 68 are provided by which the housing can be removably affixed to the crankcase by the illustrated bolt.

Figure 3:
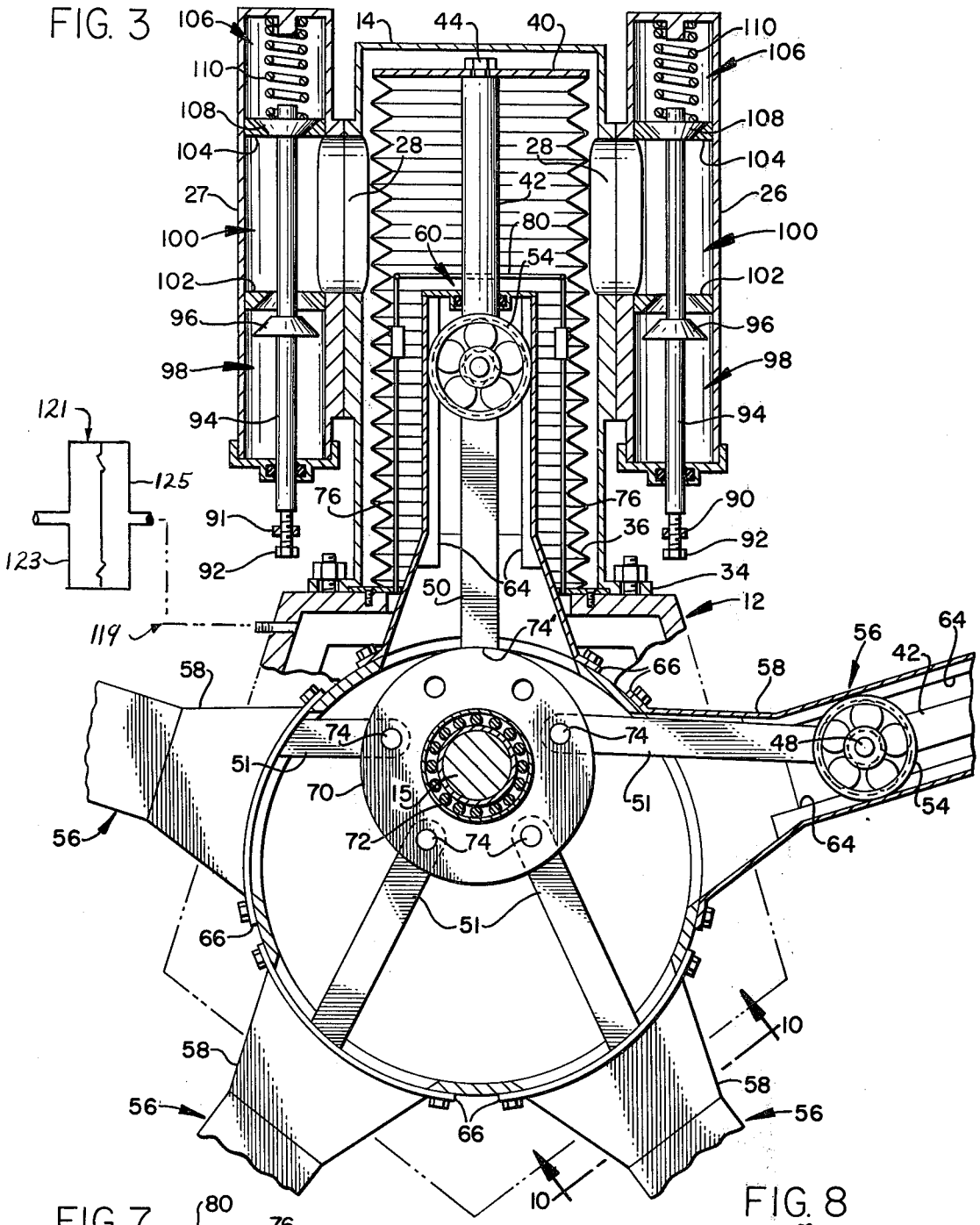
FIG. 3 is a partial cross-sectional view taken along line 3—3 of FIG. 2.
Figure 7:
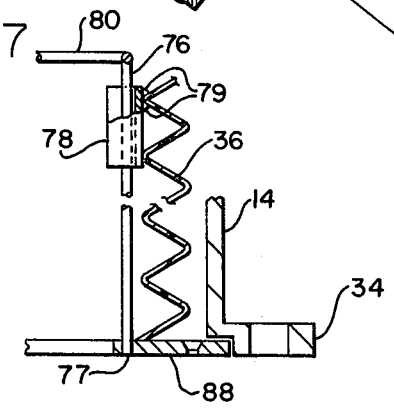
FIG. 7 is an enlarged, detailed view of an isolated part of the apparatus disclosed in FIGS. 3 and 6.
Figure 8:
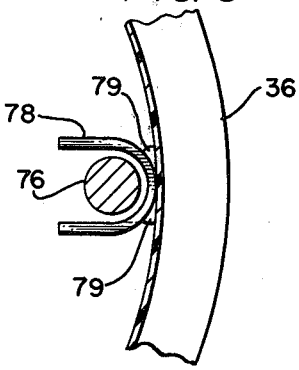
FIG. 8 is a fragmented, enlarged, part cross-sectional view of a detail of part of the apparatus disclosed in FIG. 6.
Figure 4:
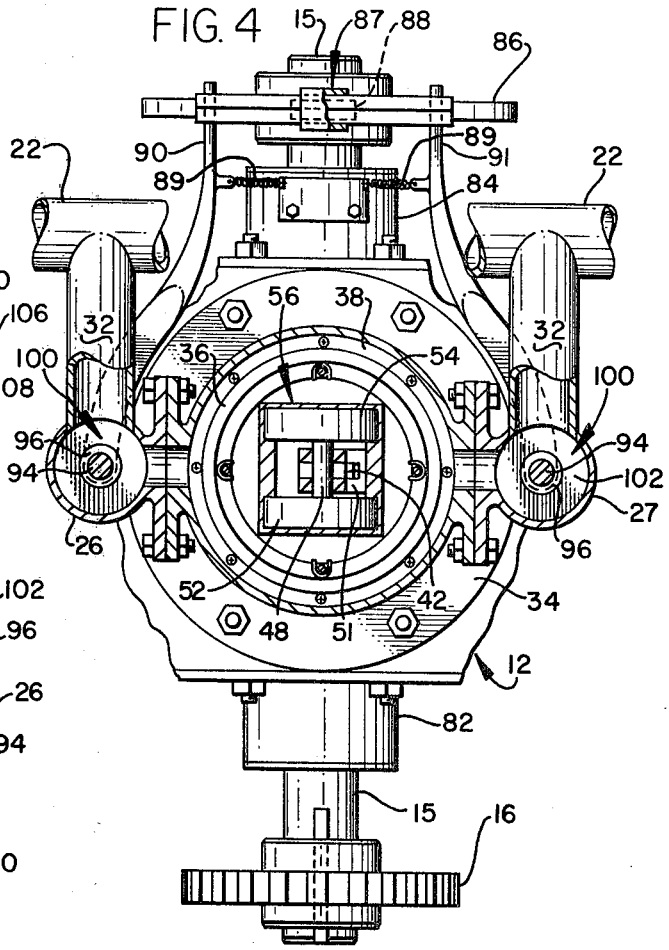
FIG. 4 is an enlarged, detailed, cross-sectional view which discloses part of the apparatus seen disclosed in the foregoing figures.

In FIG. 3, one of the link rods 50 forms the master rod and therefore is rigidly affixed to a boss 70. The remaining link rods 51 are journaled to the boss by means of pins 74. Bearing 72 journals the boss to the throw of the crankshaft.

In FIGS. 2 and 6–8, longitudinal extending guide rods 76 are radially spaced from and placed parallel to the axial centerline of the bellows and cylinder with the lower terminal end 77 thereof being attached to bellows flange 28. U-shaped channel guide 78 is of limited length and is attached by silver solder 79 to the inside wall of the bellows. Ring 80 is attached to the free end of each of the guide rods 76. The U-shaped channel guide 78 slidably engages the guide rod 76 as the bellows reciprocates within the cylinder, thereby maintaining proper alignment therebetween.

Figure 11:
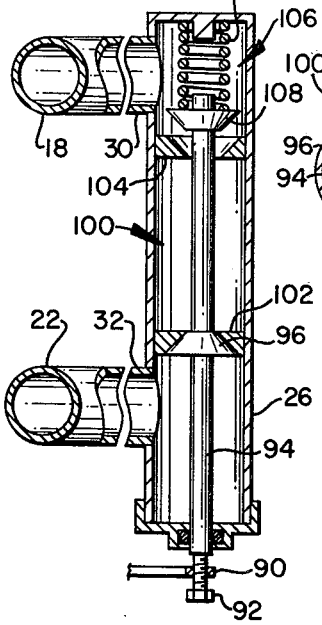
FIGS. 11 and 12 are cross-sectional views of part of the apparatus disclosed in FIG. 4.
Figure 12:
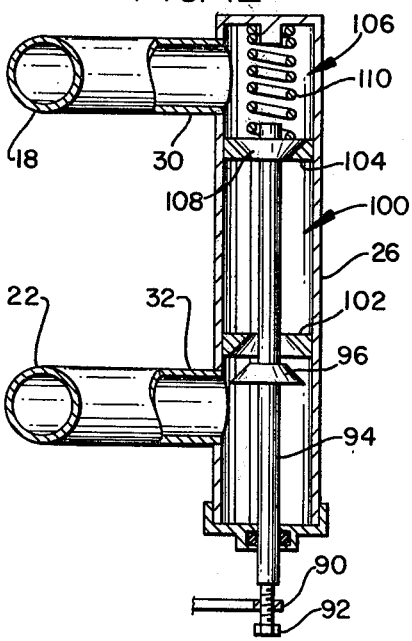
Figure 13:
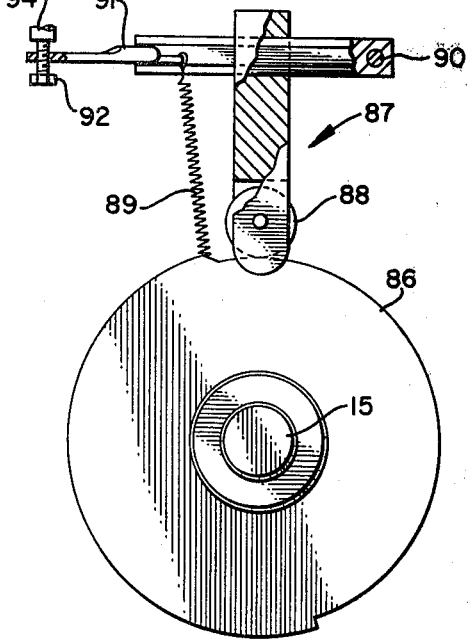
FIG. 13 is an enlarged, detail view of part of the apparatus disclosed in FIG. 4; and, FIG. 14 is a diagrammatical representation of one method by which the air motor of the present invention can be utilized.

In FIG. 2, numeral 82 indicates a bearing located in the power output end of the case through which the marginal output end of the shaft is received. A bearing 84 is located in the opposed end of the crankcase and receives the opposed end of the shaft therethrough. In FIGS. 2 and 13, the cam 86 is affixed to the shaft end for actuating a cam follower 87. The follower includes a roller assembly at 88 by which valve actuator arms 90 and 91 are moved vertically. Spring 89 maintains the cam and follower in low friction engagement with one another. Each of the valve actuator arms terminate in a valve lifter 92. As shown in FIG. 11 or 12 the valve lifter engages lower end 94 of a valve stem. The valve stem includes the illustrated spaced apart valve elements 96 and 108.

In FIGS. 1, 4, 11, 12, and 14, compressed air at intake manifold 24 is connected to chamber 98, which is separated from chamber 100 by valve seat 102. Valve element 96 is received by the seat and prevents flow from chamber 98 into chamber 100. Chamber 100 is directly connected to the expansible chamber of the air motor. Dual valve assemblies are used at 26 and 27 to maintain symmetrical forces on the bellows.

Valve seat 104 separates chamber 106 from common chamber 100. Valve element 108 is received by valve seat 104. Biasing means 110 biases the valve so that the valve stem 94 is always in engagement with the valve lifter 92.

The various figures of the drawings illustrate that the cylinder assembly can be removed by first removing the inlet and exhaust lines therefrom and thereafter unbolting the fasteners from the cylinder flange 34, whereupon the cylinder can be lifted thereby leaving the bellows 36 exposed to view. Next the bellows is removed by unbolting fastener 44 and thereafter removing the fasteners from the flange whereupon the bellows is lifted free of the crankcase thereby leaving the rod assembly extending from the case. As the bellows is removed from the case, the guides 76 and 78 are removed therewith. Next the guide means 56 is removed from the crankcase by unbolting the fasteners from the flange 66 and removing the housing from the aperture resulting from the removal of the cylinder. As the guide 56 is removed, the rollers 52, 54 become derailed as the assembly is outwardly removed from the crankcase.

Each of the link pins are next removed from the boss of the master rod with the master rod being retained by the crankshaft. The main crankshaft can next be split at the main journal using known techniques, after the crankcase has been separated, thereby completely disassembling the entire air motor.

In FIG. 2 a nipple 120 is connected to inlet 122 of an air breather 124 so that the interior of the crankcase is vented to the atmosphere at 126. The crankcase is lubricated in any conventional manner.

As seen in FIG. 3, the isolated chamber is connected to an expansion chamber 121 by flow conduit 119. The expansion chamber compensates for temperature changes in the oil, which also changes the volume thereof. The chamber 121 includes an enclosure separated into an inlet side 125 and an outlet side 123 by means of the illustrated expansible diaphragm. The side 123 is connected to the air pressure at 24, thereby subjecting all of the oil filled isolated chambers to the pressure of the power fluid.

Figure 14:
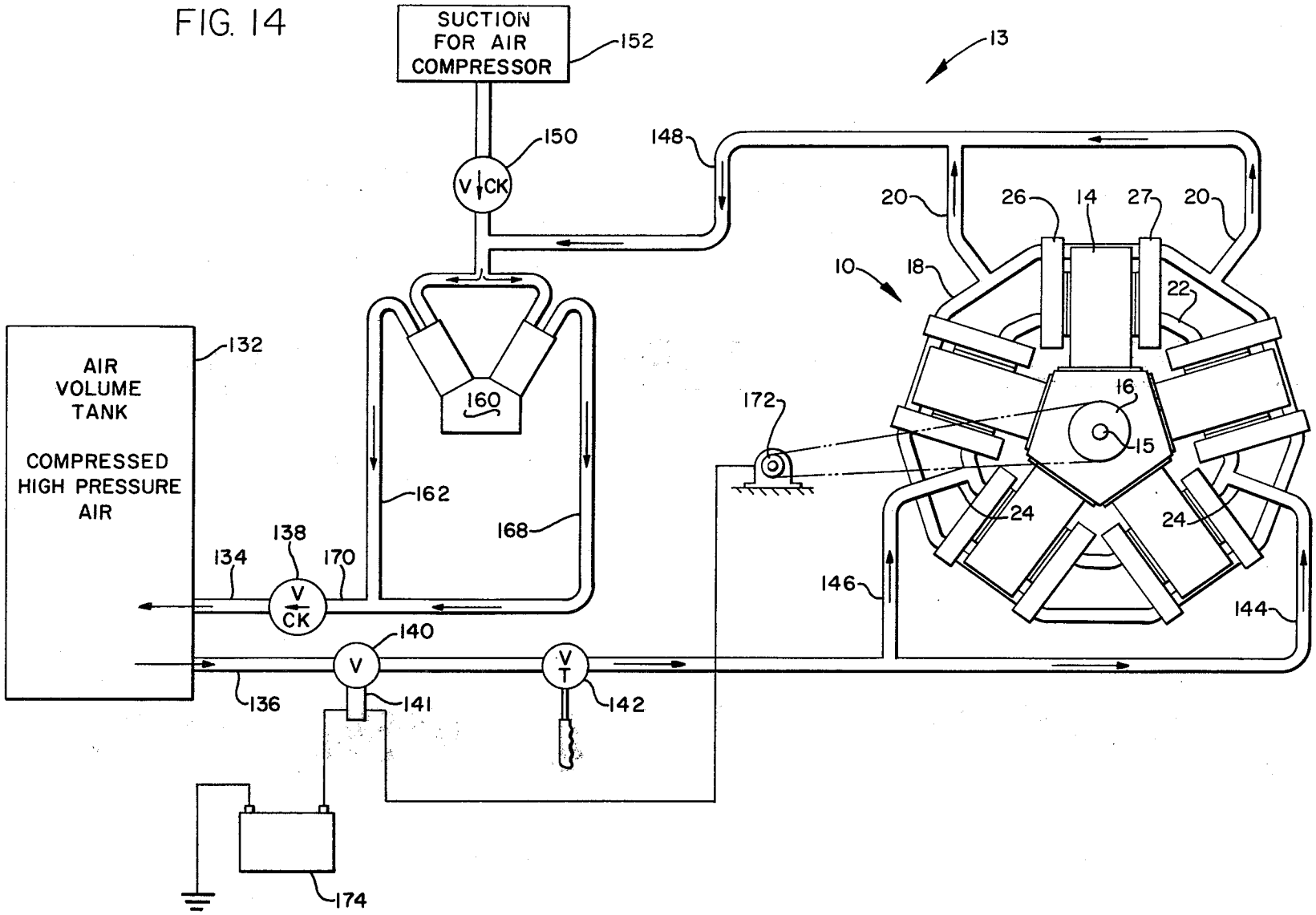

In FIG. 14, air storage tank 132 is connected to inlet flow line 134 and outlet flow line 136. Check valve 138 prevents flow upstream of line 168 while solenoid 141 controls flow through valve 140. Throttle valve 142 is manually operated by the illustrated control handle. Compressed air at 144 and 146 flows into the before recited supply lines 24.

Exhaust line 148 is connected to the before mentioned exhaust pipes 20, and to a compressor 160. Check valve 150 connects the compressor to a filtered source of atmospheric air. Lines 162 and 168 connect the compressor to the storage tank 132.

In operation, compressed air at 24 flows into intake manifold 22. As the cam 88 rotates against the follower, valve actuator arm 90 is actuated, thereby causing the valve lifter to move the valve stem 94 into the illustrated position of FIG. 11. Spent power fluid is exhausted from the bellows annulus into chamber 100, through seat 104 and into the outlet manifold of the motor. At the same time, another valve assembly is in the illustrated configuration of FIG. 12 whereupon compressed air or power fluid flows from the manifold into chamber 98; through seat 102 and into the annular cylinder chamber, whereupon the bellows is partially collapsed thereby causing the bellows rod to reciprocate in a downward direction, with the link rod imparting rotational motion into the crankshaft.

As the bellows are sequentially subjected to the force of the compressed air, the corresponding bellows rod is forced to move radially inwardly, while the displacement of the adjacent isolated chamber diminishes in size. Simultaneously the displacement of an opposed isolated chamber increases in size. Since the isolated chambers are connected together and filled with oil, and since the total displacement of the chambers is a constant value, there is an interaction between all of the chambers during the rotation of the crankshaft. This interaction causes the bellows of an expansion chamber on the exhaust stroke to move the bellows rod in an outward direction as the bellows of an opposed chamber moves its corresponding rod inwardly, thereby subjecting all of the connecting rods to an appropriate force which rotates the crankshaft with a smooth power input. This places a constant force on the crankshaft for 360° of rotation.

Operation of the motor continues in this manner with there always being a plurality of cylinders on the power stroke and a plurality of cylinders on the exhaust stroke.

The crankcase interior is provided with a suitable lubricant by which all of the co-acting parts associated with the crankshaft are maintained properly lubricated. Seal 62 prevents oil flowing from the isolated chamber 69. Those skilled in the art of air motors will appreciate that the displacement within the crankcase as well as the isolated chambers is always constant.

As the crankshaft of the air motor is forced to rotate, the bearing or follower 52, 54 reciprocate within the parallel longitudinally extended tracks 64 thereby maintaining the bellows rod 42 in axial alignment with the bellows and cylinder. This expedient, together with the guide means 76 and 78, maintains the bellows in concentric relationship respective to the cylinder and prevents the bellows from inadvertently contacting the wall of the cylinder. This novel combination eliminates uneven or unsymmetrical bending of the bellows and always avoids unsymmetrical forces being placed thereon. The air pressure surrounding the bellows forces the convolutions thereof to collapse, thereby driving the bellows rod toward the crankshaft.

Dual valve assemblies 26 and 27 are provided for each of the cylinders. This expedient provides equal and opposite forces applied to opposed sides thereof as well as a minimum pressure drop from the inlet manifold into the cylinder and from the cylinder into the exhaust manifold.

The novel valve assembly of the present invention includes a minimum number of moving parts and requires a single valve lifter 92 for both the intake and exhaust valve elements 96 and 108.

The housing of the guide assembly 56 supports the rail 64 which cooperates with rollers 52, 54. The housing further supports the seal 62 which sealingly engages the bellows rod 42. This cooperative action of the seal and guide means, both of which are supported from the housing which in turn is supported from the crankcase and extends up into the bellows, brings about several unexpected and novel results as pointed out above. The guide assembly also forms the isolated chambers 69.

The present air motor preferably is made with a plurality of cylinders radially spaced about a common crankshaft in the manner of the illustrations contained within the drawings. It is contemplated to use other cylinder arrangements, as for example, a six cylinder in-line engine as well as a V-8 engine wherein the cylinders and bellows along with the rod assemblies are made in accordance with the teachings of this disclosure.

I claim:

1. An air motor having a crankcase, a plurality of expansion chambers, a crankshaft, a rod assembly;

means journaling said crankshaft within said crankcase with a marginal end of the crankshaft extending from the crankcase to enable power to be delivered by the air motor;

each of said expansion chambers includes a cylinder affixed to said crankcase, a cylindrical bellows concentrically arranged within said cylinder, means by which a lower end of said bellows is affixed to the lower end of said cylinder to form an annular expansion chamber therebetween;

said rod assembly having one end thereof journaled to said crankshaft and the other end thereof affixed to the upper end of said bellows;

guide means by which a marginal outer end of said rod assembly is axially aligned respective to said bellows and cylinder;

said guide means includes a hollow, outwardly directed enclosure having a lower skirt member affixed to said crankcase in spaced relationship to the fixed end of the bellows, an upper end of said guide means extends into said bellows and includes an upper seal member thereon which sealingly receives a marginal length of said rod assembly;

an intake and exhaust valve assembly connected to said annular expansion chamber, a valve actuator means connected to said crankshaft and to said intake and exhaust valve assembly for emitting air into said annular expansion chamber on the downstroke and exhausting air from said annular expansion chamber on the upstroke of said rod assembly;

said rod assembly includes a link rod and a bellows rod, one end of said link rod being affixed to said crankshaft, one end of said bellows rod being affixed to said bellows, the other end of said link and bellows rods being journaled to one another;

said guide means includes a bearing member and a track; said link rod and bellows rod being connected together by said bearing member, said bearing member rides in said track with the track being disposed parallel to the axial centerline of said cylinder so that reciprocatory motion of the bellows rod imparts oscillatory motion into one end of said link rod;

so that the interior of the crankcase is separated from the interior of the bellows by said housing and seal member, with there being an isolated chamber formed between said expansion chamber and said crankcase.

2. The air motor of claim 1 wherein said expansion chambers are radially disposed about said crankshaft.

3. An air motor having a crankcase, a crankshaft journaled within said crankcase, a plurality of cylinders supported by said crankcase, each cylinder being arranged in aligned relationship respective to a throw of said crankshaft;

a bellows, a rod assembly, said bellows being concentrically aligned with said cylinder, a lower end of said bellows being affixed to a lower end of said cylinder, thereby leaving an annulus between said bellows and cylinder, a closure member at the top of said bellows; a closure member at the top of said cylinder, thereby forming an expansible chamber between said bellows and cylinder;

valve means for controlling flow of compressed air into and out of said expansible chamber;

one end of said rod assembly being connected to said bellows closure member, the other end of said rod assembly being journaled to said crankshaft so that fluid pressure effected in said expansible chamber forces the bellows closure member to move towards said crankshaft while said connecting rod imparts rotational movement into said crankshaft;

said rod assembly includes a link rod and a bellows rod, a guide means having one end extending into the bellows and another end affixed to said crankcase with said one end of said guide means reciprocatingly receiving a marginal length of said bellows rod therethrough; one end of said link rod is affixed to said crankshaft, one end of said bellows rod is affixed to said bellows, means by which the other end of said link and bellows rods are journaled to one another and connected to said guide means such that said marginal end of said bellows rod is maintained in axial alignment respective to said cylinder;

said guide means includes an enclosure having a base, a seal means mounted on said enclosure in opposition to said base, said base being affixed to said crankcase such that a marginal end of the rod assembly is received through said seal means, thereby forming an isolated chamber within the interior of said bellows, means by which each isolated chamber of said engine is filled with oil and placed in fluid communication with one another.

4. An air motor having a crankcase, a crankshaft journaled within said crankcase, a plurality of cylinders supported by said crankcase, each cylinder being arranged in aligned relationship respective to a throw of said crankshaft;

a bellows, a rod assembly, said bellows being concentrically aligned with said cylinder, a lower end of said bellows being affixed to a lower end of said cylinder, thereby leaving an annulus between said bellows and cylinder, a closure member at the top of said bellows; a closure member at the top of said cylinder, thereby forming an expansible chamber between said bellows and cylinder;

valve means for controlling flow of compressed air into and out of said expansible chamber;

one end of said rod assembly being connected to said bellows closure member, the other end of said rod assembly being journaled to said crankshaft so that fluid pressure effected in said expansible chamber forces the bellows closure member to move towards said crankshaft while said connecting rod imparts rotational movement into said crankshaft;

said rod assembly includes a link rod and a bellows rod, a guide means having one end extending into the bellows and another end affixed to said crankcase with said one end of said guide means reciprocatingly receiving a marginal length of said bellows rod therethrough; one end of said link rod is affixed to said crankshaft, one end of said bellows rod is affixed to said bellows, means by which the other end of said link and bellows rods are journaled to one another and connected to said guide means such that said marginal end of said bellows rod is maintained in axial alignment respective to said cylinder;

said guide means includes a hollow, outwardly directed enclosure having a lower, circumferentially extending skirt member affixed to said crankcase and an upper seal member which sealingly receives a marginal length of said rod assembly therethrough;

said guide means further includes a track means which guidably receives the journaled connection between the link and bellows rods, said track means being aligned parallel to the axial centerline of the cylinder and bellows so that the bellows is compressed, thereby reciprocating the bellows rod and moving the link rod to thereby rotate the crankshaft.

5. An air motor having a crankcase, a crankshaft journaled within said crankcase, a plurality of cylinders supported by said crankcase, each cylinder being arranged in aligned relationship respective to a throw of said crankshaft;

a bellows, a rod assembly, said bellows being concentrically aligned with said cylinder, a lower end of said bellows being affixed to a lower end of said cylinder, thereby leaving an annulus between said bellows and cylinder, a closure member at the top of said bellows; a closure member at the top of said cylinder, thereby forming an expansible chamber between said bellows and cylinder;

valve means for controlling flow of compressed air into and out of said expansible chamber;

one end of said rod assembly being connected to said bellows closure member, the other end of said rod assembly being journaled to said crankshaft so that fluid pressure effected in said expansible chamber forces the bellows closure member to move towards said crankshaft while said connecting rod imparts rotational movement into said crankshaft;

said rod assembly includes a link rod and a bellows rod, a guide means having one end extending into the bellows and another end affixed to said crankcase with said one end of said guide means reciprocatingly receiving a marginal length of said bellows rod therethrough; one end of said link rod is affixed to said crankshaft, one end of said bellows rod is affixed to said bellows, means by which the other end of said link and bellows rods are journaled to one another and connected to said guide means such that said marginal end of said bellows rod is maintained in axial alignment respective to said cylinder;

said guide means includes a housing, a bearing member, and a track;

said journal by which said link rod and bellows rod are connected together includes said bearing member, said bearing member rides in said track with the track being mounted in said housing and disposed parallel to the axial centerline of the cylinder so that reciprocatory motion of the bellows rod imparts oscillatory motion into said link rod;

said housing forms an isolated chamber and is located between said case and said expansion chamber.

6. The motor of claim 5 wherein said guide means is a hollow, outwardly directed enclosure having a lower, circumferentially extending skirt member affixed to said crankcase and spaced from said bellows, an upper seal member mounted in said housing which sealingly receives said rod assembly therethrough;

said track includes means for guidably receiving the journaled connection between the link and bellows rods, so that when the bellows is compressed, the bellows rod reciprocates to move the link rod and rotate the crankshaft.

7. The motor of claim 6 wherein said expansion chambers are radially disposed about said crankshaft.

8. The motor of claim 5 wherein said bellows closure member together with said crankcase and said bellows form an isolated chamber, each said chamber being filled with non-compressible fluid and placed in communication with one another so that as one expansible chamber increases in volume there is a corresponding decrease brought about in another chamber.

* * * * *